US006851957B1

(12) United States Patent
Bhogal et al.

(10) Patent No.: US 6,851,957 B1
(45) Date of Patent: Feb. 8, 2005

(54) ALL-IN-ONE NETWORK CABLE AND SECURITY CABLE

(75) Inventors: Kulvir Singh Bhogal, Fort Worth, TX (US); Alfredo Gutierrez, Cedar Park, TX (US); Nizamudeen Ishmael, Jr., Austin, TX (US); Rohit R. Sahasrabudhe, Louisville, KY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/687,250

(22) Filed: Oct. 16, 2003

(51) Int. Cl.[7] ..... H01R 13/44
(52) U.S. Cl. ..... 439/133; 439/304
(58) Field of Search ..... 439/133, 304, 439/638, 676, 354

(56) References Cited

U.S. PATENT DOCUMENTS 4,074,928 A * 2/1978 Johnston ..... 439/304
4,311,883 A * 1/1982 Kidney ..... 379/443
4,647,726 A * 3/1987 Blum ..... 379/435
4,740,168 A * 4/1988 Carney et al. ..... 439/133
4,911,646 A * 3/1990 Marson et al. ..... 439/133
5,556,295 A * 9/1996 McFadden et al. ..... 439/301
6,321,579 B1 11/2001 Reyes ..... 70/58
6,522,532 B2 * 2/2003 Liao et al. ..... 361/686
2004/0139354 A1 * 7/2004 Jones et al. ..... 713/202

* cited by examiner

*Primary Examiner*—Tho D. Ta
(74) *Attorney, Agent, or Firm*—Duke W. Yee; Diana R. Gerhardt; Stephen J. Walder, Jr.

(57) ABSTRACT

An all-in-one network communication cable and security cable apparatus for securing computing devices is provided. The all-in-one cable combines the security aspects of a steel or other cut-proof cable with a network communication cable and provides a locking mechanism that only permits the authorized user to disconnect the all-in-one cable from the computing device and the structure mounted network communication connection jack. In one exemplary embodiment of the present invention, a standard RJ45 Ethernet Cable is provided with a cut-proof casing and a slidable locking sheath that is capable of being slid under the depressible lever of the RJ45 connector. This locking mechanism includes a lock that may be set by the user so that the locking mechanism is not removable without the proper key or combination. The slidable locking sheath, when engaged, does not allow the lever of the RJ45 connector to be depressed.

20 Claims, 3 Drawing Sheets

ALL-IN-ONE NETWORK CABLE AND SECURITY CABLE

BACKGROUND OF THE INVENTION

1. Technical Field

The present invention is directed to an improved network communication cable for use with computing devices. More specifically, the present invention is directed to a network communication cable that includes a cut-proof casing and locking mechanism for securing a computer to a network cable connector affixed to a structure.

2. Description of Related Art

As computers have become more prevalent in today's society, the necessity of having a computer available practically at all times has permeated today's work environment. This is especially true when employees travel to other locations, such as customer sites and the like. In such situations, the employee will typically take a portable computer with him/her to the other location for use while the employee is operating in this other location. For example, a company issued laptop computer may be taken to the customer location and used to provide communication abilities with the employee's office work location, provide presentations, and the like Many times while at another location, the user's computer may not be within the user's immediate supervision. That is, for example, the employee may need to leave the computer in a particular location while attending to other matters in a different location while at the customer site. In such cases, it is important that the user be able to secure the computer from theft.

One way in which a user may secure his/her computer is by way of a dedicated security cable system which allows the user to attach a steel or other secure cable to the computing device and attach the cable to a stationary fixture. For example, a loop may be provided on the computer through which the steel cable may be passed and then secured to a fixture in an office. The steel cable may include a lock that may be engaged for ensuring that the steel cable cannot be removed by anyone other than the user.

This approach is not satisfactory for a number of reasons. First, it requires that the user purchase and carry with him/her a separate dedicated cable simply for securing the computer. Second, it requires that the computing device be augmented to include physical hardware features that allow for the attachment of the security cable to the computer.

Thus, it would be beneficial to have a mechanism for securing a computer that does not require a separate dedicated security mechanism and does not require special hardware on the computer for securing of the computer.

SUMMARY OF THE INVENTION

The present invention provides an all-in-one network communication cable and security cable apparatus for securing computing devices. The present invention combines the security aspects of a steel or other cut-proof cable with a network communication cable and provides a locking mechanism that only permits the authorized user to disconnect the all-in-one cable from the computing device and the structure mounted network communication connection jack.

In one exemplary embodiment of the present invention, a standard RJ45 Ethernet Cable is provided with a cut-proof casing and a slidable locking sheath that is capable of being slid under the depressible lever of the RJ45 connector. This locking mechanism includes a lock that may be set by the user so that the locking mechanism is not removable without the proper key or combination. The slidable locking sheath, when engaged, does not allow the lever of the RJ45 connector to be depressed.

In operation, the RJ45 connector at one end of the all-in-one cable is inserted into the network connection jack that is affixed to a structure. The RJ45 connector at the other end of the all-in-one cable is inserted into the network connection jack of a built-in network card of the computing device.

As is known in the art, in order to remove an RJ45 connector from a RJ45 connection jack once the RJ45 connector is inserted, the lever of the RJ45 connector must be depressed. The locking sheaths of the present invention may be slid under the RJ45 connector levers after insertion of the RJ45 connectors into the network connection jacks and then secured by a lock, e.g., a padlock or combination lock. The locking sheaths are configured such that the RJ45 connector levers are not depressible. As a result, the all-in-one cable cannot be removed from the network connection jacks without the proper key or combination.

Thus, the present invention provides a convenient mechanism for securing a computing device that makes use of a network communication cable that will typically be carried by a user. Since the present invention does not require an additional piece of hardware, i.e. a dedicated security cable, it is more likely that users will make use of the all-in-one cable of the present invention as opposed to the security cable required in the prior art. Moreover, since the present invention makes use of existing hardware in computers and offices, i.e. the network communication jacks, there is no need to modify the computer to include hardware whose sole purpose is for securing the computer.

These and other features and advantages of the present invention will be described in, or will become apparent to those of ordinary skill in the art in view of, the following detailed description of the preferred embodiments.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
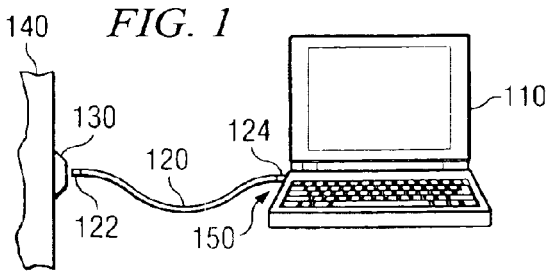
FIG. 1 is an exemplary diagram illustrating the manner by which the all-in-one cable of the present invention may be connected to a computer and a structure in accordance with one exemplary embodiment of the present invention.

FIG. 1 is an exemplary diagram illustrating a mechanism according to an exemplary embodiment of the present invention for securing a computing device to a location. The present invention will be described in terms of portable computing devices, such as laptop computers, that make use of a network cable connection in order to communicate over a network with other computing devices. However, the present invention is not limited to portable computing devices and may be used with any type of computing device, such as desktop computing devices, that communicates over a network by way of a network communication cable.

As shown in FIG. 1, the computing device 110, which in the depicted example is a laptop computer, is in need of being secured to a location in order to prevent theft of the laptop computer. Typically, in the prior art, a separate dedicated steel cable would be required to be passed through a hardware feature of the laptop computer 110 and then secured to a fixture within the location. The present invention, however, alleviates the need for a separate dedicated steel cable and instead integrates the features of a security cable with those of a network communication cable to provide a combined all-in-one cable 120 that serves to both secure the computing device to the location and provide network communication capability.

The all-in-one cable 120 includes a network communication cable having a cut-proof casing, preferably made of a metal material such as steel, and locking devices 122–124 at the ends of the all-in-one cable 120. The ends of the all-in-one cable 120 preferably include connectors (not explicitly shown) which engage connector receptacles associated with connector jacks. For example, the network communication cable aspect of the all-in-one cable 120, in a preferred embodiment, is an Ethernet cable having RJ45 connectors at the ends of the Ethernet cable. This Ethernet cable is then encased in a cut-proof casing with locking mechanisms provided at the ends of the modified Ethernet cable, as discussed herein below.

When in operation, one end of the all-in-one cable 120 is inserted into a connector jack 130 affixed to a structure 140, e.g. a wall, of the location. The other end of the all-in-one cable 120 is inserted into a connector jack 150, e.g., an integrated network interface card jack, that is affixed to the laptop computer 110.

After having connected the all-in-one cable 120 to both connector jacks 130 and 150, locking mechanisms 122–124 are engaged at the ends of the all-in-one cable 120 so that the ends of the cable are secured to the connector jacks 130 and 150, respectively. In this way, the ends of the all-in-one cable 120 are secured to the connector jacks 130 and 150 such that they may not be removed, the all-in-one cable 120 is cut-proof by virtue of the cut-proof casing, and thus, the laptop computer 110 is secured to the location. Moreover, while the all-in-one cable 120 provides mechanisms for securing the laptop computer 110 it also allows communication via the same all-in-one cable 120 with a data network, such as a local area network, wide area network, the Internet, and the like.

As mentioned above, the locking mechanisms 122–124 secure the ends of the all-in-one cable 120 to connector jacks 130 and 150 associated with a structure 140 in the location and the computing device 110. As an example, in a preferred embodiment, the locking mechanisms 122–124 include a locking sheath that is capable of being placed under the depressible lever of a standard RJ45 connector at the ends of the all-in-one cable 120 and thereby cause the lever to no longer be depressible. Since the lever must be depressed in order to disengage the connector from the connector jack, the end of the all-in-one cable 120 cannot be removed until the locking sheath is removed. The locking sheath is preferably lockable such that only the user of the laptop computing device 110 is able to remove the locking sheaths via the use of a key, combination, or other mechanism.

Figure 2A:
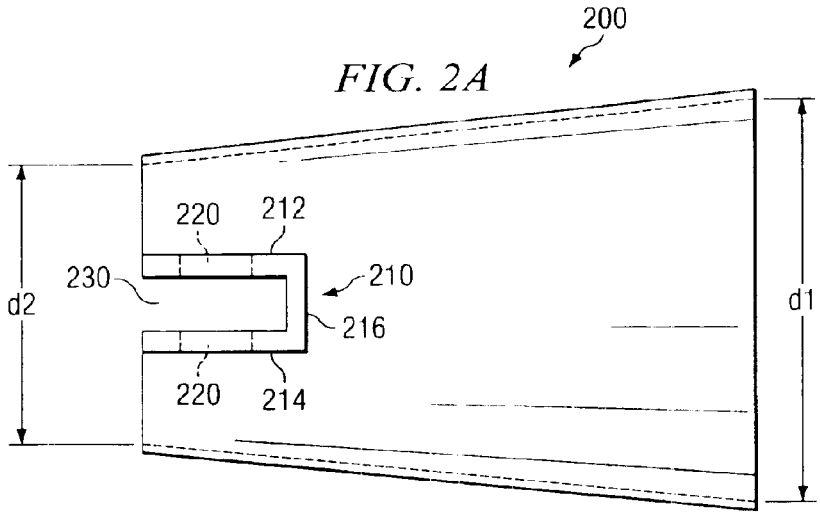
FIG. 2A is a first view of a locking sheath of one exemplary embodiment of the present invention.
Figure 2B:
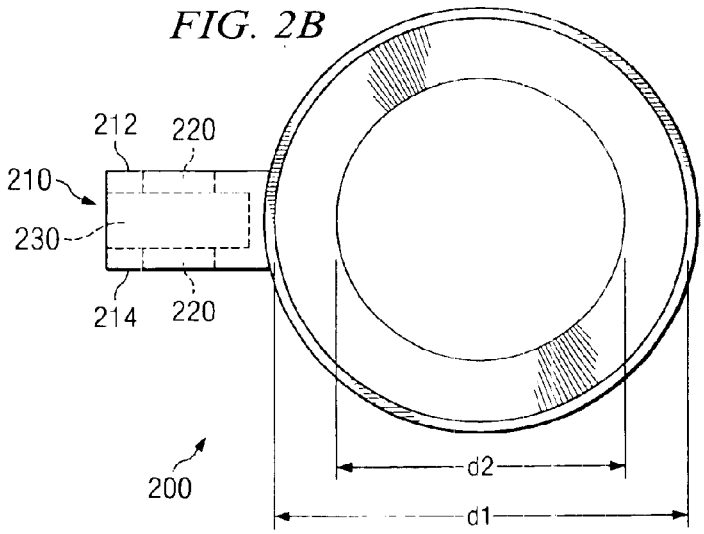
FIG. 2B is a right-side view of the first view of the locking sheath shown in FIG. 2A.
Figure 2C:
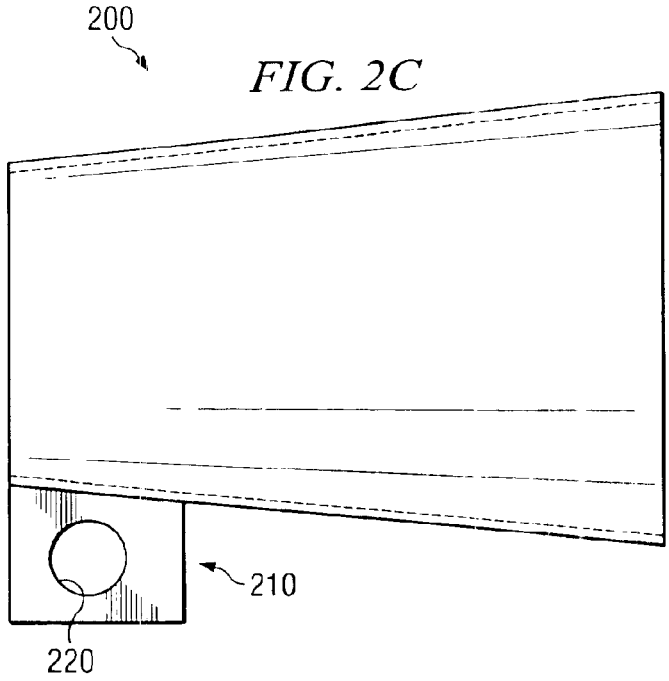
FIG. 2C is a top-side view of the first view of the locking sheath shown in FIG. 2A.

FIGS. 2A–2C illustrate various views of the locking sheath according to a preferred embodiment of the present invention. As shown in FIGS. 2A–2C, the locking sheath has a circular cross-section with a tapering diameter such that the sheath 200 has a wider diameter d1 at a back end than the diameter d2 at a front end of the sheath. The tapering of the diameter d1 to d2 is preferably such that the slope of the taper approximately matches the angle produced by a depressible lever of a standard RJ45 connector when it is engaged into an RJ45 connector jack. In this way, the lever of the RJ45 connector will not be able to be depressed when the locking sheath is engaged and locked.

The sheath 200 includes a locking feature 210 to which a lock may be attached. In the depicted example, the locking feature 210 is configured for use with a padlock type lock that may make use of a key or combination to secure the lock, however, the present invention is not limited to such. Rather, the lock itself may be integrated into the sheath such that the locking feature includes the lock.

In the depicted example, the locking feature 210 comprises a pair of surfaces 212 and 214 protruding outward from the tapering cylindrical sheath 200 and are formed as a single piece with a back surface 216. A gap 230 is provided between the two surfaces 212 and 214 such that a mating piece (not shown) may be slid between the two surfaces 212 and 214 into the slot 230 with the back surface 216 providing a stop for the mating piece as well as giving greater strength to the two surfaces 212–214. The mating piece is preferably affixed or integrated into the RJ45 connector at the end of the all-in-one cable.

An opening is provided in the surfaces 212 and 214 of the locking feature 210 through which a padlock arm may be passed. When the locking sheath is engaged with the RJ45 connector such that the mating piece, which has a corresponding opening, is slid between the two surfaces 212 and 214, the arm of the padlock may pass through the openings 220 in the surfaces 212 and 214 as well as the opening in the mating piece of the RJ45 connector. This effectively secures the sheath 200 to the RJ45 connector such that it is not moveable without removing the padlock.

The sheath 200 and the locking feature 210 may be formed from any suitable material. In a preferred embodiment, the sheath 200 is formed from a strong plastic material having an appropriate thickness that makes the sheath 200 difficult to break. A plastic material is preferred since it will tend to not interfere with the electrical wiring of the RJ45 connector. However, if appropriate shielding is provided, the sheath 200 may be formed from a metal material as well. Of course other materials, which may be apparent to those of ordinary skill in the art, may be used without departing from the spirit and scope of the present invention.

Figure 3:
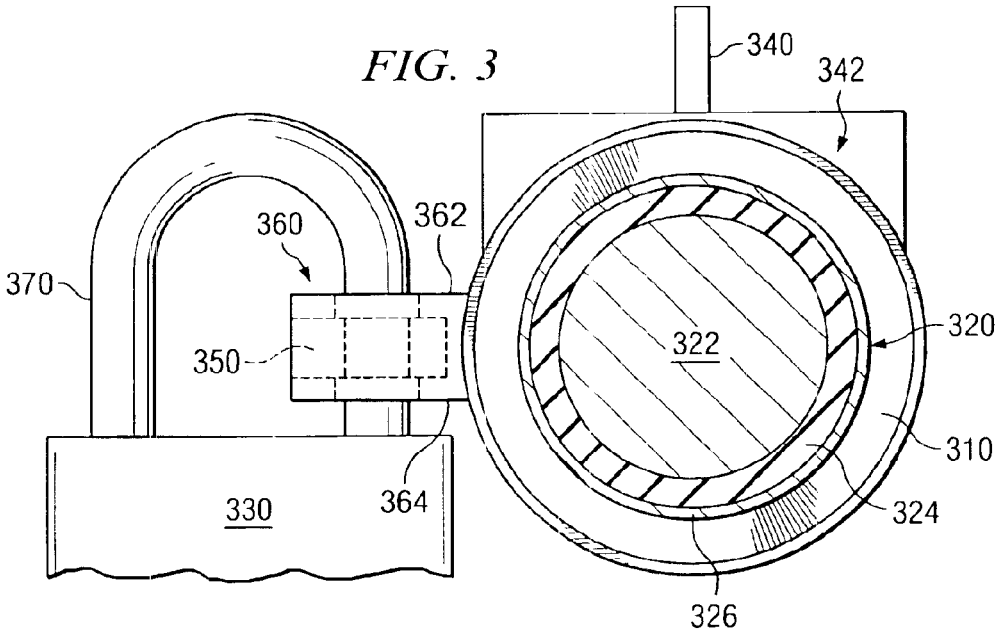
FIG. 3 is an exemplary diagram illustrating a cross-section of a lock portion of an all-in-one cable in accordance with the present invention.

FIG. 3 is an exemplary diagram illustrating a cross-section of a lock portion of an all-in-one cable in accordance with the present invention. The illustration in FIG. 3 shows the locking sheath 310 in relation to the cable 320 and a padlock 330.

As shown in FIG. 3, the locking sheath 310 is slidable over the all-in-one cable 320 such that it may be placed under the depressible lever 340 of the connector 342. The all-in-one cable 320 includes communication electrical wiring section 322 surrounded by electrical shielding 324, which in turn is encased in the cut-proof casing 326. The electrical wiring section 322 and electrical shielding 324 are standard network connection cable components, such as may be found in a standard Ethernet cable, while the cut-proof casing 326 is provided by the present invention. The cut-proof casing 326 may be fashioned from any cut-poof material appropriate to the particular implementation of the present invention. In a preferred embodiment, the cut-proof casing is fashioned from steel which is shielded from the electrical wiring of the all-in-one cable by the shielding section 324.

When engaged with the connector 342, a mating piece 350 is slid into the opening provided between surfaces 362 and 364 of the locking feature 360 of the sheath 310. Openings in the surfaces 362 and 364 align with an opening in the mating piece 350 such that the arm 370 of a padlock 330 may pass through the opening and be inserted into the base of the padlock for securing the sheath 310 to the connector 342. The padlock may be secured by way of a keyed lock or combination such that the arm 370 cannot be removed from the opening in the surfaces 362, 364 and the opening in the mating piece 350. In this way, the sheath 310 is secured into place under the lever 340 such that the lever 340 cannot be depressed and, as a result, the connector 342 cannot be removed from the connector jack.

Figure 4:
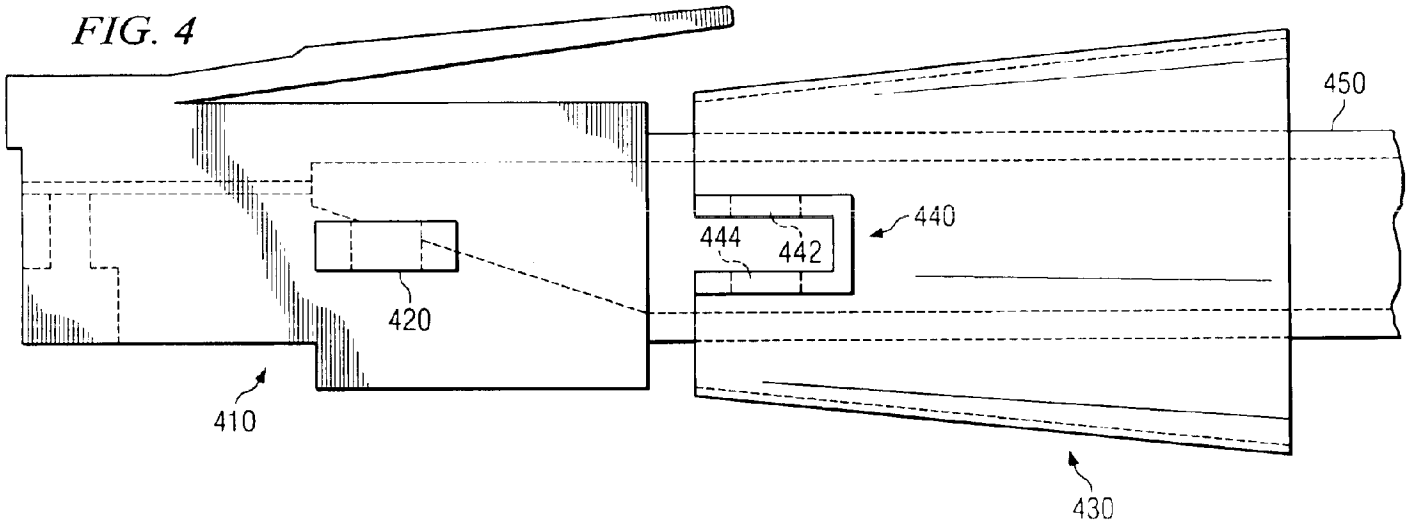
FIG. 4 is an exemplary diagram illustrating the locking sheath of one exemplary embodiment in an nonengaged stated relative to the RJ45 connector.

FIG. 4 is an exemplary diagram illustrating the locking sheath of one exemplary embodiment in a nonengaged state relative to the RJ45 connector. As shown in FIG. 4, the RJ45 connector 410 includes a mating piece 420 that is attached or integrated into the RJ45 connector 410. This mating piece 420 is a protruding piece of material having a large enough thickness to provide strength against breaking. The mating piece 420 further includes an opening which is positioned to align with openings 442–444 in the locking feature 440 of a locking sheath 430.

Prior to engaging with the RJ45 connector 410, the locking sheath 430 is slidable along the all-in-one cable 450. That is, the diameter d2 of the front end of the sheath is large enough to provide clearance between the casing of the all-in-one cable 450 and the locking sheath 430. The diameter d2 of the front end is also large enough to permit the locking sheath 430 to slide over the rear portion of the RJ45 connector 410.

Since approximately half of the length of the RJ45 connector 410 will be placed within the connector jack for coupling to allow network data communication via the all-in-one cable 450, the mating piece 420 is preferably located in a rear portion of the RJ45 connector 410. The mating piece 420 not only provides a mechanism for securing the locking sheath 430 to the RJ45 connector 410 but it also provides a stop for the locking sheath 430 such that the locking sheath 430 cannot be pushed further than the mating piece 420 toward the end of the all-in-one cable 450.

Figure 5:
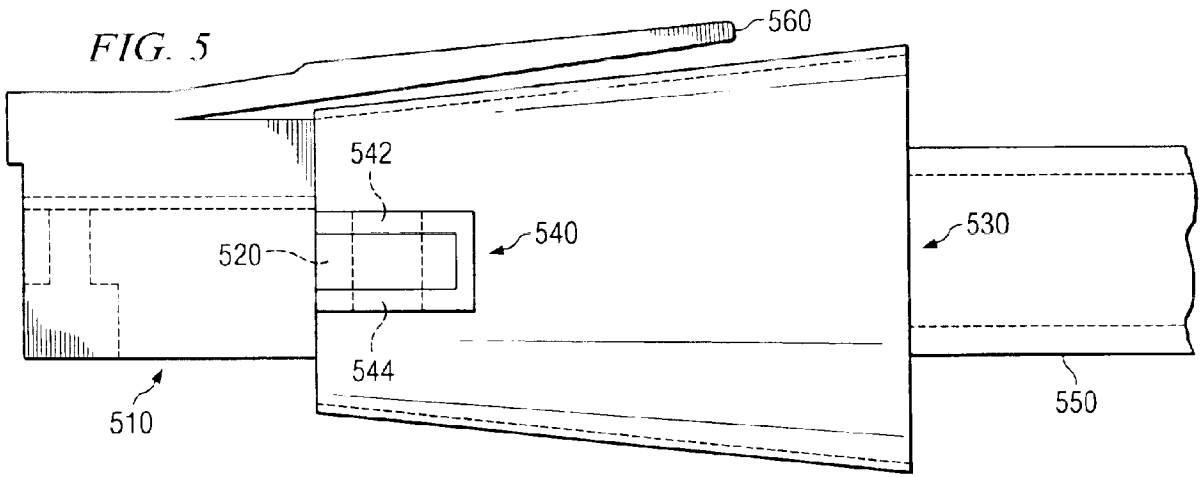
FIG. 5 is an exemplary diagram illustrating the locking sheath of one exemplary embodiment in an engaged state relative to the RJ45 connector.

FIG. 5 is an exemplary diagram illustrating the locking sheath of one exemplary embodiment in an engaged state relative to the RJ45 connector. As shown in FIG. 5, when the locking sheath 530 is oriented appropriately and pushed up so that the mating piece 520 slides between the surfaces of the locking feature 540, the upper surface of the locking sheath 540 prevents depression of the lever 560 of the RJ45 connector 510. Thus, since the lever 560 cannot be depressed, the RJ45 connector 510 cannot be removed from the connector jack into which it is placed. As a result, the all-in-one cable 550 is secured to the connector jack by way of the locking sheath 540 and the mating piece 530 of the RJ45 connector 510.

A portion of a lock, such as an arm of the lock, may be passed through the openings in the locking feature 540 and the mating piece 520 and used to secure the locking sheath 530 to the RJ45 connector 510. Any type of lock that has a portion that may be passed through the openings in the locking feature 540 and the mating piece 520 may be used with this embodiment of the present invention without departing from the spirit and scope of the present invention. In a preferred embodiment, the lock may be a small luggage type keyed or combination padlock that has a curved arm that can be passed through the openings.

A locking sheath 530 and RJ45 connector 510 such as that shown in FIGS. 4 and 5 may be provided at each end of the all-in-one cable 550. In this way, the all-in-one cable 550 may be secured at both ends using the locking sheaths 530, RJ45 connectors 510, and locks. Thus, when the all-in-one cable 550 of the present invention is properly connected to a computing device and to a connector jack associated with a structure, the computing device will be securely tethered to the structure by way of the all-in-one cable 550. This helps to prevent theft of the computing device by making it more difficult for a would-be thief to remove the computing device from its location.

Moreover, the all-in-one cable 550, while providing security against theft, also provides a mechanism for allowing network data communication via the all-in-one cable 550. Thus, one cable is all that is necessary in order to both secure a computing device and connect it to a data network.

While the present invention has great advantages when used with portable computing devices, such as laptop computers, by providing a convenient mechanism for both securing the portable computing device and providing a network communication path for the portable computing device, the benefits of the present invention may also be achieved when used with more stationary computing devices. For example, the all-in-one cable of the present invention may be used with desktop systems or other computing devices that tend to be moved rarely. With the all-in-one cable of the present invention, a company may secure a computing device to an office using the mechanisms of the present invention thereby preventing theft of equipment from the company's premises while also using the all-in-one cable to provide a network connection to the company's LAN. Other uses and implementations of the present invention may be made without departing from the spirit and scope of the present invention.

In addition, while the above description provides an exemplary embodiment of the present invention, it should be appreciated that the above description is not intended to be limiting in any way with regard to the manner of implementing or the configuration of the all-in-one cable of the present invention. For example, rather than an RJ45 connector or Ethernet cable, the present invention may make use of other types of connectors and data communication cables without departing from the spirit and scope of the present invention so long as there is a way for securing the cable to a computing device and to a connector jack of a structure.

Moreover, while the present invention has been described in terms of a sheath that is slidable under a depressible lever of a RJ45 connector, the present invention is not limited to such. Rather, any configuration of the sheath may be used that makes it unlikely for the RJ45 connector to be removed from a connector jack. For example, rather than sliding under the depressible lever, the sheath may be large enough to cover the lever and thereby make it difficult to depress the lever.

Additionally, other embodiments for securing the locking sheath in position relative to the depressible lever may be used without departing from the spirit and; scope of the present invention. For example, protrusions may be provided in the casing of the all-in-one cable near the RJ45 connector such that the locking sheath may slide over the protrusions when in an unlocked state. However, when the locking sheath is locked, the diameter of the locking sheath is reduced to a level where the locking sheath can no longer be slid over the protrusions. In essence, the locking of the locking sheath causes the sheath to be squeezed to a smaller diameter while still providing sufficient diameter to prevent depression of the lever of the RJ45 connector.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. An apparatus for securing a computing device to a location, comprising:

a network communication cable having a cut-resistant casing;

a first locking mechanism provided at a first end of the network communication cable; and a second locking mechanism provided at a second end of the network communication cable, wherein the network communication cable provides a data communication link with a data network, the first locking mechanism is capable of locking the network communication cable to a structure at the location, and the second locking mechanism is capable of locking the network communication cable to the computing device;

a first connector at the first end of network communication cable; and a second connector at the second end of the network communication cable, wherein the first locking mechanism is capable of being secured to the first connector and the second locking mechanism is capable of being secured to the second connector, and wherein the first locking mechanism and the second locking mechanism are locking sheaths that are slidable under a depressible portion of the first connector and the second connector such that when the locking sheath is under the depressible portion of the first connector and the second connector, the depressible portion is no longer depressible to release the first connector and the second connector.

2. The apparatus of claim 1, wherein the first locking mechanism and the second locking mechanism include locking sheaths having a first end with a first diameter larger than a second diameter of a second end and being slidable along the network communication cable.

3. The apparatus of claim 1, wherein the cut-proof casing is a steel cable casing.

4. The apparatus of claim 1, wherein the first locking mechanism and the second locking mechanism include integrated keyed or combination locks.

5. The apparatus of claim 1, wherein the network communication cable includes an Ethernet cable having RJ45 connectors at each end of the Ethernet cable.

6. The apparatus of claim 5, wherein the RJ45 connectors have a mating piece for engaging with a locking feature of the fit locking mechanism and the second locking mechanism.

7. The apparatus of claim 1, wherein the first locking mechanism and second locking mechanism have locking features for engaging with mating pieces of the first connector and second connector, respectively.

8. The apparatus of claim 7, wherein the locking features and the mating pieces having openings through which a portion of a lock may be passed.

9. The apparatus of claim 7, wherein the locking features are surfaces protruding from the locking mechanism wherein the surfaces form a slot into which the mating piece may be slid.

10. The apparatus of claim 9, wherein the locking features and the mating pieces have openings through which an arm of a padlock may be passed.

11. The apparatus of claim 1, wherein the network communication cable further includes:

a first connector at the first end of the network communication cable for coupling the network communication cable to a data communication jack of one of the computing device and the structure; and a second connector at the second end of the network communication cable for coupling the network communication cable to a data communication jack of the other of the computing device and the structure.

12. The apparatus of claim 11, wherein the first connector and the second connector are RJ45 connectors and wherein the network communication cable is an Ethernet cable.

13. A method of making a security cable for securing a portable computing device at a location, comprising:

providing a network communication cable;

providing a cut-resistant casing surrounding the network communication cable;

providing a first locking mechanism at a first end of the network communication cable; and providing a second locking mechanism at a second end of the network communication cable, wherein the network communication cable provides a data communication link with a data network, the first locking mechanism is capable of locking the network communication cable to a structure at the location, and the second locking mechanism is capable of locking the network communication cable to the computing device;

providing a first connector at the first end of network communication cable; and providing a second connector at the second end of the network communication cable, wherein the first locking mechanism is capable of being secured to the first connector and the second locking mechanism is capable of being secured to the second connector, and wherein the first locking mechanism and the second locking mechanism are locking sheaths that are slidable under a depressible portion of the first connector and the second connector such that when the locking sheath is under the depressible portion of the first connector and the second connector, the depressible portion is no longer depressible to release the first connector and the second connector.

14. The method of claim 13, wherein the network communication cable includes an Ethernet cable having RJ45 connectors at each end of the Ethernet cable.

15. The method of claim 13, wherein the first locking mechanism and second locking mechanism are provided with locking features for engaging with mating pieces of the first connector and second connector, respectively.

16. The method of claim 15, wherein the locking features and the mating pieces are provided with openings through which a portion of a lock may be passed.

17. An apparatus for securing a computing device to a location, comprising:

an Ethernet cable having a steel cut-resistant casing;

a first locking mechanism provided at a first end of the Ethernet cable; and a second locking mechanism provided at a second end of the Ethernet cable, wherein the first locking mechanism and second locking mechanism include:

a connector having a depressible portion and a mating piece;

a slidable sheath capable of being slid under the depressible portion such that the depressible portion is no longer depressible; and a locking feature having a gap into which the mating piece of the connector may be slid, wherein the locking feature and the mating piece have holes through which a portion of a lock may be passed when the holes in the locking feature and the mating piece are aligned.

18. An apparatus for securing a computing device to a location, comprising:

a network communication cable having a cut-resistant casing;

a first locking mechanism provided at a first end of the network communication cable; and a second locking mechanism provided at a second end of the network communication cable, wherein the network communication cable provides a data communication link with a data network, the first locking mechanism is capable of locking the network communication cable to a structure at the location, and the second locking mechanism is capable of locking the network communication cable to the computing device;

a first connector at the first end of network communication cable; and a second connector at the second end of the network communication cable, wherein the first locking mechanism is capable of being secured to the first connector and the second locking mechanism is capable of being secured to the second connector, and wherein the first locking mechanism and second locking mechanism have locking features for engaging with mating pieces of the first connector and second connector, respectively, wherein the first locking mechanism and second locking mechanism are provided with locking features for engaging with mating pieces of the first connector and second connector, respectively, and wherein the locking features and the mating pieces have openings through which a portion of a lock may be passed.

19. A method of making a security cable for securing a portable computing device at a location, comprising:

providing a network communication cable providing a cut-resistant casing surrounding the network communication cable;

providing a first locking mechanism at a first end of the network communication cable; and providing a second locking mechanism at a second end of the network communication cable, wherein the network communication cable provides a data communication link with a data network, the first locking mechanism is capable of locking the network communication cable to a structure at the location, and the second locking mechanism is capable of locking the network communication cable to the computing device;

providing a first connector at the fit end of network communication cable; and providing a second connector at the second end of the network communication cable, wherein the first locking mechanism is capable of being secured to the first connector and the second locking mechanism is capable of being secured to the second connector, wherein the locking features and the mating pieces are provided with openings through which a portion of a lock may be passed.

20. An apparatus for securing a communication cable to a location, comprising:

a communication cable;

a first connector at a first end of the communication cable, wherein the first connector is capable of being placed in a first communication port;

a second connector at a second end of the communication cable, wherein the second connector is capable of being placed in a second communication port;

a first locking mechanism provided at the first end of the communication cable; and a second locking mechanism provided at the second end of the communication cable, wherein the first locking mechanism is capable of locking the communication cable to the first communication port, and the second locking mechanism is capable of locking the communication cable to the second communication port, wherein the first locking mechanism is a locking sheath that is slidable along the communication cable from a non-locked position to a locked position and from a locked position to a non-locked position, and wherein when the locking sheath is in the locked position, removal of the first connector from the first communication port is prevented, and wherein when the locking sheath is in the unlocked position, removal of the first connector from the first communication port is made possible.

* * * * *

UNITED STATES PATENT AND TRADEMARK OFFICE

CERTIFICATE OF CORRECTION

PATENT NO. : 6,851,957 B1
DATED : February 8, 2005
INVENTOR(S) : Bhogal et al.

It is certified that error appears in the above-identified patent and that said Letters Patent is hereby corrected as shown below:

Column 8,
Line 6, before the first instance of "locking", delete "fit" and insert -- first --.

Column 10,
Line 16, after "at the", delete "fit" and insert -- first --.

Signed and Sealed this

Sixteenth Day of August, 2005

JON W. DUDAS
*Director of the United States Patent and Trademark Office*